US007236571B1

(12) United States Patent
Kendall et al.

(10) Patent No.: US 7,236,571 B1
(45) Date of Patent: Jun. 26, 2007

(54) SYSTEMS AND APPARATUS FOR INTEGRATED X-RAY TUBE COOLING

(75) Inventors: Charles B. Kendall, Brookfield, WI (US); Carey Shawn Rogers, Brookfield, WI (US)

(73) Assignee: General Electric, Schenectady, NY (US)

( * ) Notice: Subject to any disclaimer, the term of this patent is extended or adjusted under 35 U.S.C. 154(b) by 0 days.

(21) Appl. No.: 11/425,960

(22) Filed: Jun. 22, 2006

(51) Int. Cl.
*H01J 35/10* (2006.01)

(52) U.S. Cl. ..... 378/141; 378/142
(58) Field of Classification Search ..... 378/119, 378/130, 133, 141, 121, 142
See application file for complete search history.

(56) References Cited

U.S. PATENT DOCUMENTS 4,455,504 A * 6/1984 Iversen ..... 313/30
2004/0223588 A1* 11/2004 Subraya et al. ..... 378/141

* cited by examiner

*Primary Examiner*—Hoon Song
(74) *Attorney, Agent, or Firm*—Peter Vogel; Carl Horton; Ellis B. Ramirez

(57) ABSTRACT

An X-Ray tube is provided. The X-Ray tube includes a frame structure surrounding at least a portion of an electron beam source and an electron beam target. The frame structure has a cooling system integrated therein. The cooling system includes at least one air/fin layer; and a sub-cooled working fluid in thermal contact with the at least one air/fin layer, the sub-cooled working fluid being adapted to undergo a phase change in response to heat introduced to the frame structure by one or more of the electron beam source and the electron beam target, wherein the phase change facilitates transfer of the heat to the at least one air/fin layer.

20 Claims, 4 Drawing Sheets

SYSTEMS AND APPARATUS FOR INTEGRATED X-RAY TUBE COOLING

FIELD OF THE INVENTION

This invention relates generally to X-Ray imaging devices, and more particularly to cooling techniques for X-Ray imaging devices.

BACKGROUND OF THE INVENTION

Computed tomography (CT) imaging systems are a commonly used medical imaging tool. CT imaging, also sometimes referred to as computerized axial tomography (CAT) scanning, is based on the variable absorption of X-Rays by different tissues. CT imaging systems generate cross-sectional images of a subject.

A typical CT imaging system includes an X-Ray tube and a series of X-Ray detectors, mounted opposite the X-Ray tube, on a circular gantry. During imaging, a patient is placed on a table that passes through the center of the gantry. As the patient passes through the gantry, the gantry rotates around the patient. The X-Ray tube and X-Ray detectors on the gantry capture images of the patient from many different angles. A computer then compiles these images and produces a three-dimensional representation of the patient.

If the table moves continuously through the gantry as the gantry rotates around the patient, as occurs in many conventional CT imaging systems, the images are produced in a helical pattern. This procedure is commonly referred to as helical scanning.

The X-Ray tube in CT imaging systems typically comprises an electron beam source (cathode), a backscattered electron beam collector and an electron beam target (anode). The electron beam source, collector and target all function in generating the X-Ray beam that is used for imaging. The X-Ray beam in CT imaging systems is typically produced having a fan-shaped pattern. The shape of the X-Ray beam can be altered using a collimator, e.g., to increase or decrease the width of the beam.

The generation of the X-Ray beam by the X-Ray tube creates enormous amounts of heat, especially in the areas surrounding the electron beam target. Ninety-nine percent of the primary electron beam power is converted to thermal energy in the tube, while one percent is converted to X-Ray energy. This heat has to be removed to maintain proper operation of the X-Ray tube. Current CT imaging system designs employ forced convection cooling of the X-Ray tube using a working fluid which is then pumped to a remote fluid-to-air heat exchanger. The remote fluid-to-air heat exchanger cools the working fluid by forced air cooling. This low power density solution is mass and geometry inefficient.

Further, during imaging, it is important that patients stay very still, to prevent blurring of the image by motion. In some instances, e.g., during chest scans, in order to prevent motion, patients must hold their breath. This can be difficult and uncomfortable.

Thus, to minimize this trauma, designers are seeking to increase gantry speeds, so as to decrease the scanning time. This requires higher power levels at the X-Ray tube. Higher power levels mean higher levels of heat generation. These higher heat levels, however, can reach, or exceed, the capacity of current cooling systems. Therefore, more effective and efficient cooling techniques for CT imaging systems are needed.

For the reasons stated above, and for other reasons stated below which will become apparent to those skilled in the art upon reading and understanding the present specification, there is a need in the art for improved CT imaging cooling systems.

BRIEF DESCRIPTION OF THE INVENTION

An X-Ray tube is provided. The X-Ray tube includes a frame structure surrounding at least a portion of an electron beam source and an electron beam target. The frame structure has a cooling system integrated therein. The cooling system includes an air/fin layer; and a sub-cooled working fluid in thermal contact with the air/fin layer, the sub-cooled working fluid being adapted to undergo a phase change in response to heat introduced to the frame structure by one or more of the electron beam source and the electron beam target, wherein the phase change facilitates transfer of the heat to the at least one air/fin layer.

The X-Ray tube can further include an electron collector having an electron collector cooling system associated therewith. The electron collector cooling system includes a fluid channel surrounding the electron collector; a fluid-to-air heat exchanger connected to the fluid channel; and a pump configured to circulate a sub-cooled working fluid through the fluid channel and the fluid-to-air heat exchanger.

A computed tomography (CT) imaging system is also provided. The CT imaging system has a gantry with an array of X-Ray detectors mounted opposite an X-Ray tube. The X-Ray tube includes a frame structure surrounding at least a portion of an electron beam source and an electron beam target. The frame structure includes a cooling system integrated therein. The cooling system includes an air/fin layer; and a sub-cooled working fluid in thermal contact with the air/fin layer, the sub-cooled working fluid being adapted to undergo a phase change in response to heat introduced to the frame structure by one or more of the electron beam source and the electron beam target, wherein the phase change facilitates transfer of the heat to the at least one air/fin layer.

Systems and apparatus of varying scope are described herein. In addition to the aspects and advantages described in this summary, further aspects and advantages will become apparent by reference to the drawings and by reading the detailed description that follows.

DETAILED DESCRIPTION OF THE INVENTION

Accordingly, an X-Ray tube 216 is provided having an integrated cooling system. The integrated cooling system couples efficient heat transfer, via a sub-cooled high temperature nucleate boiling working fluid, and circulated (forced) air cooling. The integrated cooling system enhances heat transfer rates and efficiency, allowing for higher power, and thus higher heat-producing, applications. Further, the dependence on large, space-consuming conventional, remote cooling systems is eliminated.

The detailed description is divided into four sections. In the first section, a conventional X-Ray system and cooling system are described. In the second section, an overview of an improved computed tomography (CT) imaging system is provided. In the third section, apparatus of the improved CT imaging system are provided. Finally, in the fourth section, a conclusion of the detailed description is provided.

Conventional X-Ray and Cooling Systems

Figure 1:
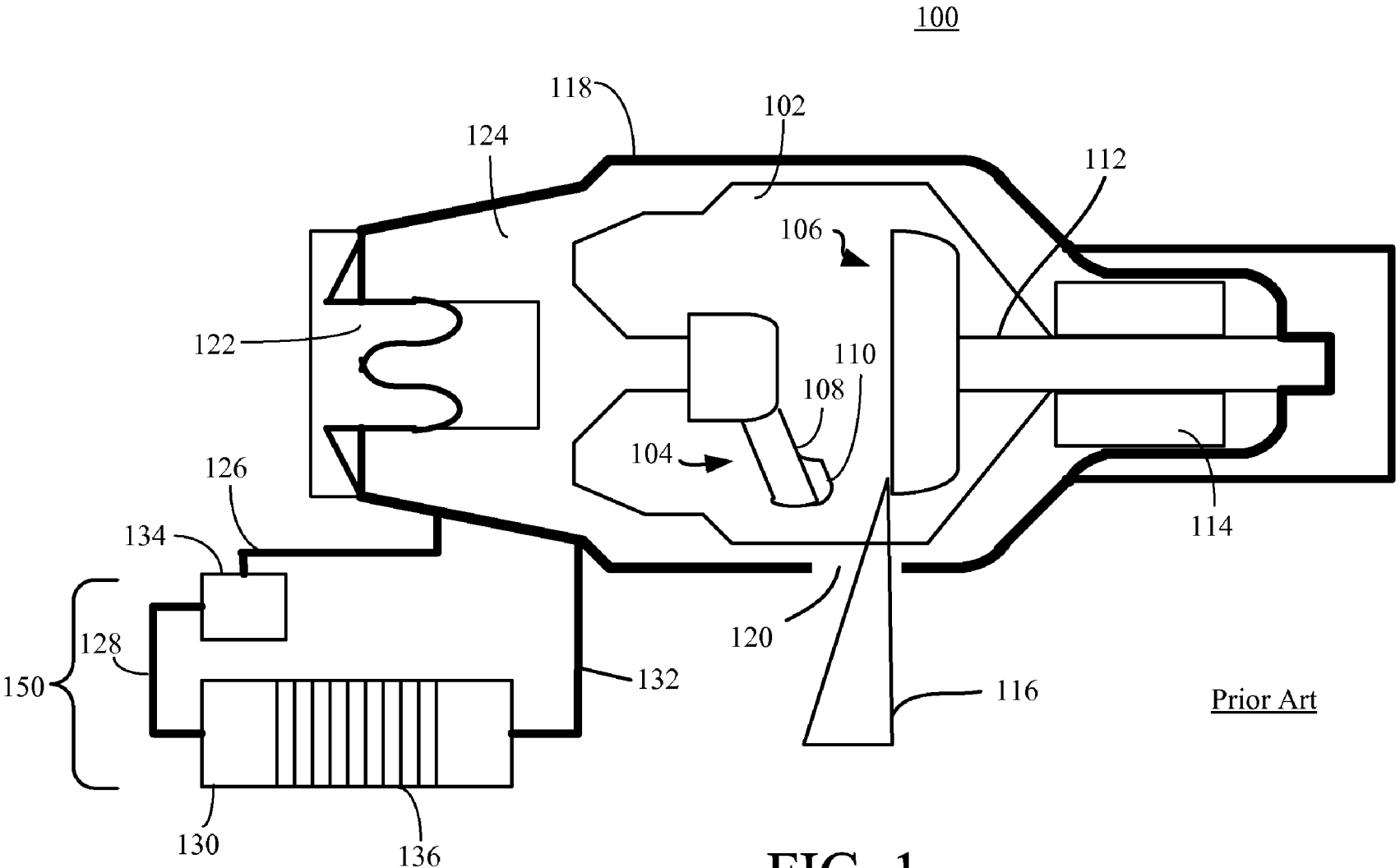
FIG. 1 is a cross-sectional diagram of a conventional X-Ray tube and cooling system.

FIG. 1 is a cross-sectional diagram of a conventional X-Ray tube 100 and cooling system 150. X-Ray tube 100 includes X-Ray tube insert 102, having electron beam source 104 and electron beam target 106.

During imaging, electron beam source 104 produces an electron beam. The generation of an electron beam by an electron beam source is well known to those of skill in the art and is not described further herein. A portion of the electron beam produced by electron beam source 104 impacts electron beam target 106. The impact of the electron beam on electron beam target 106 produces the known X-Ray spectrum. In CT applications, X-Ray beam 116 exiting X-Ray tube 100 has a fan-shaped pattern.

Electron beam target 106 is mounted on rotor 112. Stator 114 surrounds a portion of rotor 112. An electron beam target having a rotor and a stator is well known to those of skill in the art and is not further described herein.

X-Ray tube insert 102 is surrounded by housing 118. Housing 118 is typically made up of a metal such as aluminum, lead or a combination thereof. Housing 118 has port window 120 therein. Port window 120 allows X-Ray beam 116 to pass through housing 118.

Inner cavity 124 of X-Ray tube 100, as defined by the space between housing 118 and X-Ray tube insert 102, contains a working fluid. The working fluid is typically an oil-containing compound. The working fluid serves to remove heat from X-Ray tube 100 generated during imaging and may provide electrical insulation in some applications. Specifically, heat produced by electron beam source 104 and/or electron beam target 106 is radiated out to the surfaces of X-Ray tube insert 102 and transferred to the working fluid surrounding X-Ray tube insert 102.

The heated working fluid is then passed through cooling system 150. Namely, pump 134 draws the heated working fluid out of inner cavity 124, e.g., via fluid conduit 126, and pumps the heated working fluid to fluid-to-air heat exchanger 130, e.g., via fluid conduit 128. Fluid-to-air heat exchanger 130 contains a plurality of heat exchange fins 136. When the heated working fluid passes through fluid-to-air heat exchanger 130, heat exchange fins 136 help dissipate heat from the working fluid to the ambient air. This fluid-to-air transfer of heat can be passive, although most heat exchangers include a fan to facilitate heat dissipation.

The working fluid, cooled by passage through fluid-to-air heat exchanger 130, is pumped by pump 134 back into inner cavity 124, e.g., via fluid conduit 132. Although fluid conduits 126 and 132 are shown in close proximity in FIG. 1 for ease of depiction, the cooled working fluid is typically re-introduced to a side of inner cavity 124 opposite a side of inner cavity 124 from which the heated working fluid is drawn.

As mentioned above, conventional cooling system 150 is inefficient. Namely, since it is a separate and remote cooling system, conventional cooling system 150 takes up valuable space on an X-Ray imaging device. Further, heat transfer between the working fluid and the ambient air in fluid-to-air heat exchanger 130 is inefficient due to an often low temperature difference between the working fluid and the ambient air. Additionally, a cooling system employing a conventional single-phase working fluid, such as oil, may not have a heat transfer rate that is sufficient to accommodate increasingly higher power applications.

System Overview

Figure 2:
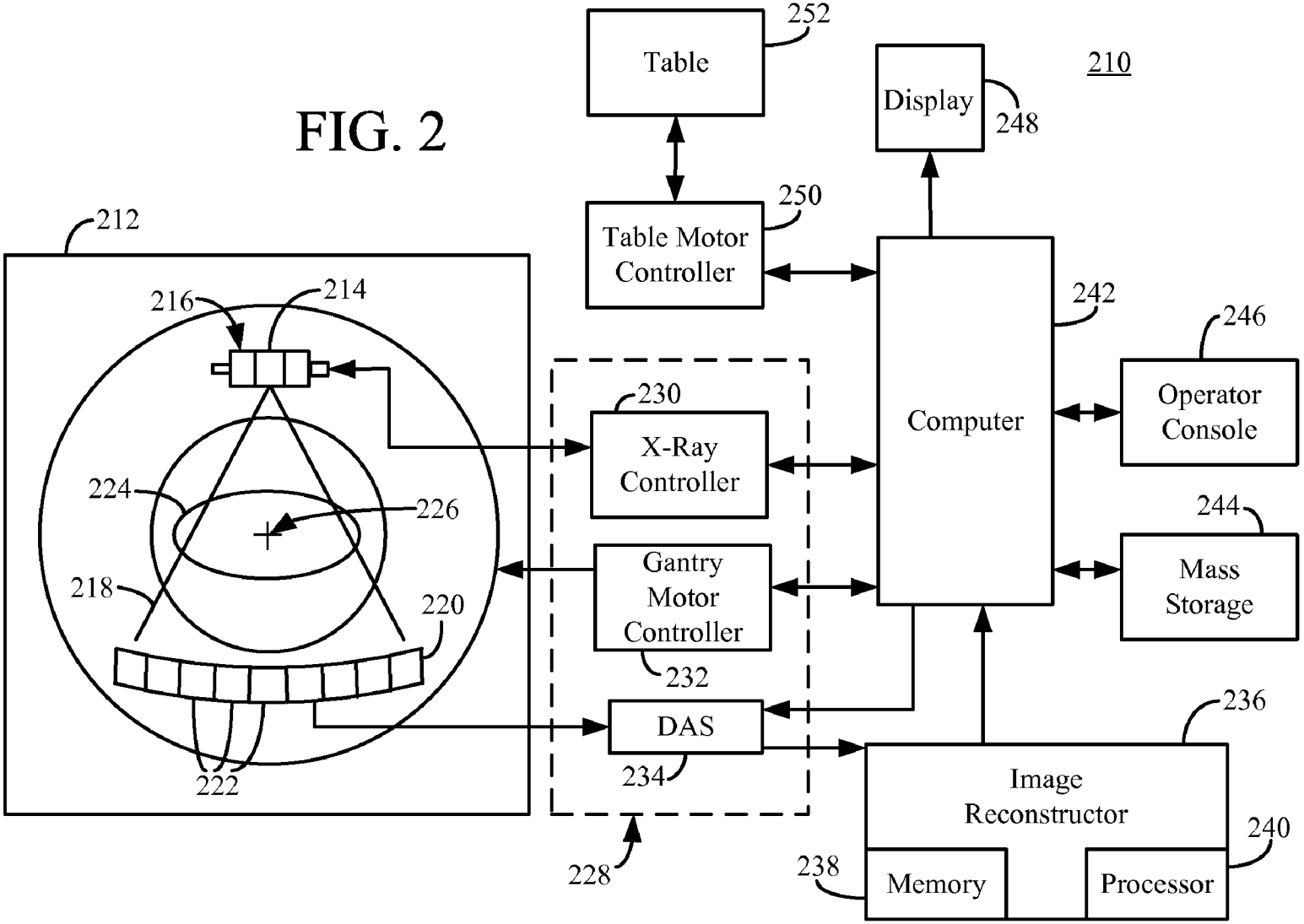
FIG. 2 is a diagram of an illustrative computed tomography (CT) imaging system.

FIG. 2 is a diagram of illustrative computed tomography (CT) imaging system 210. CT imaging system 210 includes gantry 212 that is representative of a "third generation" CT scanner. Gantry 212 includes housing unit 214 that holds X-Ray tube 216. X-Ray tube 216 projects a beam of X-Rays 218 toward array 220 of X-Ray detectors 222 on an opposite side of gantry 212. As will be described in detail below, X-Ray tube 216 has an integrated cooling system that employs nucleate boiling of a sub-cooled, high temperature working fluid and circulated (forced) air cooling to remove heat from X-Ray tube 216.

X-Ray detectors 222 together sense the projected X-Rays that pass through a medical patient 224, or other imaging object. Each of X-Ray detectors 222 produces an electrical signal that represents the intensity of an impinging X-Ray beam and hence the attenuation of the X-Ray beam as the X-Ray beam passes through patient 224. During operation of CT imaging system 210, gantry 212 and the components mounted thereon rotate about an axis of rotation 226.

The rotation of gantry 212 and the operation of X-Ray tube 216 are governed by control mechanism 228 of CT imaging system 210. Control mechanism 228 includes X-Ray controller 230 that provides power and timing signals to X-Ray tube 216 and gantry motor controller 232 that controls the rotational speed and position of gantry 212. Data acquisition system (DAS) 234 in control mechanism 228 samples analog projection data from X-Ray detectors 222 and converts the analog data to digital projection data for subsequent processing. Image reconstructor 236 receives into its memory 238 the digitized X-Ray projection data from DAS 234 and comprises a processor 240 that performs a high-speed image reconstruction algorithm, as defined by the program signals stored in the memory. The reconstructed image is applied as an input to computer 242, which stores the image in mass storage device 244.

Computer 242 also receives commands and scanning parameters from an operator via console 246 that has, e.g., a keyboard. An associated cathode ray tube display 248 allows the operator to observe the reconstructed image and other data from computer 242. Operator-supplied commands and parameters are used by computer 242 to provide control signals and information to DAS 234, X-Ray controller 230 and gantry motor controller 232. In addition, computer 242 operates table motor controller 250, which controls motorized table 252 to position patient 224 in gantry 212. For an axial scan, also known as a "stop-and-shoot scan," table 252 indexes patient 224 to a location, and allows gantry 212 to rotate about patient 224 at the location. In contrast, for a helical scan, table 252 moves patient 224 at a table speed s equal to a displacement along the z-axis per a rotation of CT imaging system 210 about gantry 212.

While the following description will be directed to X-Ray tubes (and integrated cooling systems associated therewith) in conjunction with a CT imaging system, it is to be understood that the techniques described herein are broadly applicable to many different X-Ray generating devices.

Apparatus Embodiments

Figure 3:
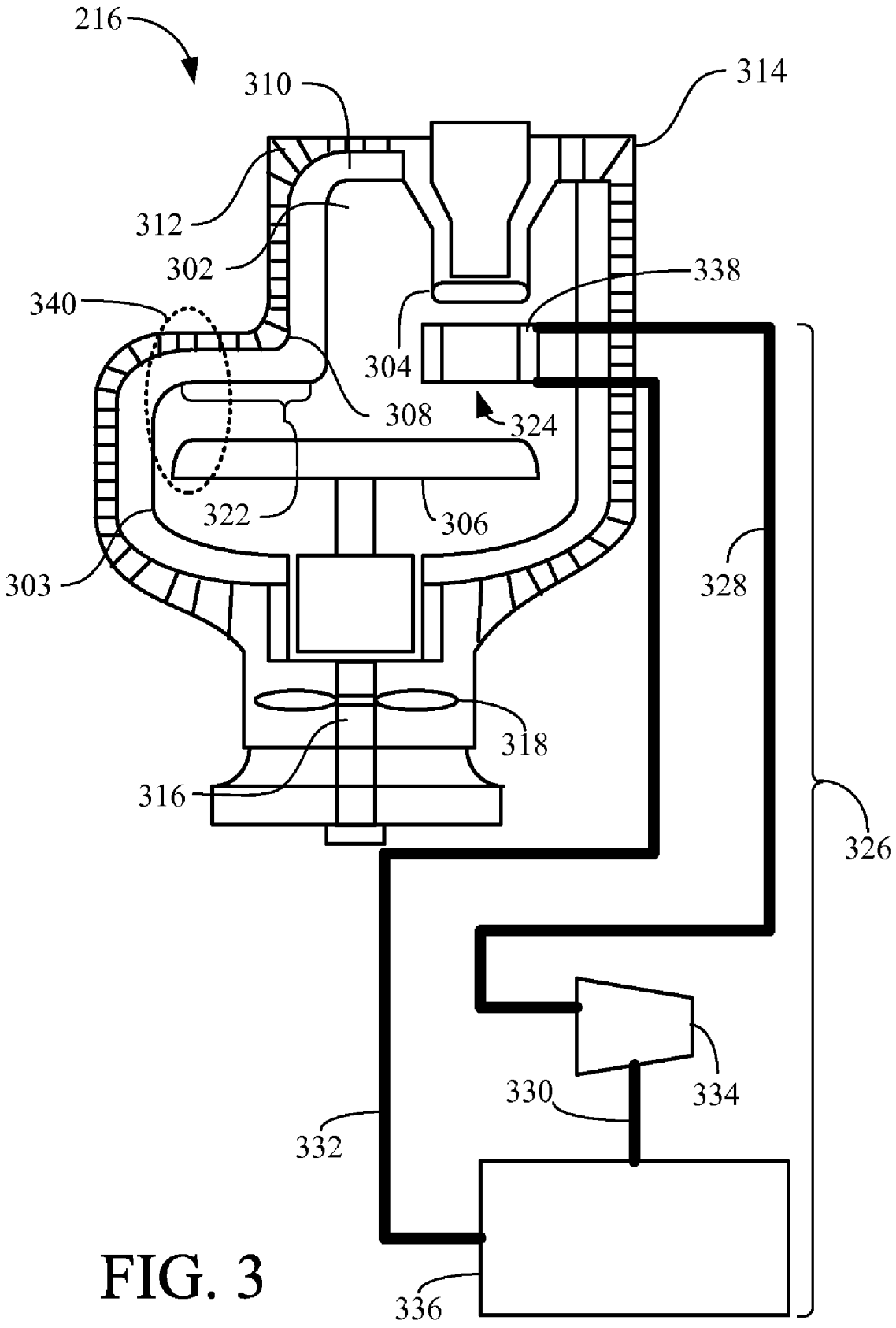
FIG. 3 is a cross-sectional diagram of an illustrative X-Ray tube having an integrated cooling system.

FIG. 3 is a cross-sectional diagram of X-Ray tube 216 having an integrated cooling system. X-Ray tube 216 includes X-Ray tube insert 302 having an outer structure thereof defined by insert wall 303. Insert wall 303 is composed of a metallic material, including, but not limited to, stainless steel. X-Ray tube insert 302 contains electron beam source 304 and electron beam target 306 mounted on rotor 316. As will be described in detail below, rotor 316 includes fan 318.

Surrounding at least a portion of X-Ray tube insert 302 is an integrated cooling system. The integrated cooling system includes casing wall 308 surrounding a portion of insert wall 303 and defining cavity 310 therebetween.

Cavity 310 contains a high temperature working fluid. Suitable high temperature working fluids include, but are not limited to, Therminol®, manufactured by Solutia, Inc. of St. Louis, Mo. The high temperature working fluid is present in a pressurized state, e.g., the fluid is at a pressure higher than the normal saturation pressure of the fluid for a given temperature. For example, according an illustrative embodiment, the high temperature working fluid is subjected to a higher than normal atmospheric pressure, rendering the high temperature working fluid in a pressurized state. Fluids present in such a pressurized state are known as sub-cooled fluids. Thus, the high temperature working fluid, when in a pressurized state, will be hereinafter referred to as "the sub-cooled high temperature working fluid." The function of the sub-cooled high temperature working fluid in the integrated cooling system will be described in further detail below.

During imaging, electron beam source 304 and/or electron beam target 306 generate a large amount of heat, e.g., typically one to 10 kilowatts (kW), that is radiated out towards insert wall 303. Insert wall 303 then becomes a heat interface with the sub-cooled high temperature working fluid, i.e., the heat is transferred by insert wall 303 to the sub-cooled high temperature working fluid by forced convection and forced sub-cooled nucleate boiling as the temperature of insert wall 303 rises.

Heat introduced to the sub-cooled high temperature working fluid via insert wall 303 will cause the sub-cooled high temperature working fluid to boil. Bubbles will form in the sub-cooled high temperature working fluid on the surfaces of insert wall 303. The bubbles will break free from the surfaces of insert wall 303 carrying heat with them. Once away from the surfaces of insert wall 303, the bubbles will collapse, as the bulk temperature of the sub-cooled high temperature working fluid is less than the temperature of the sub-cooled high temperature working fluid proximate to the surfaces of insert wall 303. The temperature of the bulk of the sub-cooled high temperature working fluid is maintained below the boiling temperature at the given pressure conditions. Heat will then be released into the sub-cooled high temperature working fluid. As will be described in detail below, the heat is subsequently removed from the sub-cooled high temperature working fluid by circulated (forced) air cooling via an air/fin layer.

This cooling arrangement at the insert wall is very efficient as it utilizes the latent heat of vaporization, i.e., the amount of heat required to convert unit mass of a liquid into a vapor without a change in temperature, of the sub-cooled high temperature working fluid to remove a large amount of heat, e.g., typically one to 10 kW, from insert wall 303. Employing a two-phase (i.e., liquid-vapor) working fluid greatly improves the heat transfer rate at insert wall 303 and provides for the storage of thermal energy in the sub-cooled high temperature working fluid, so as to allow for a slower heat transfer rate at air/fin layer 312 (described below). The advantage of using boiling heat transfer in this application is that the heat transfer coefficient is typically an order of magnitude higher than single phase forced convection, thereby requiring much less surface area to transfer a given amount of heat. It is also beneficial in that the heat transfer at casing wall 308 can take place isothermally at a high temperature again resulting in much more space efficient heat transfer. As such, the present working fluid is highly efficient for heat transfer applications. Further, the use of a high efficiency heat transfer working fluid means that, for a given application, less working fluid is required.

It is notable that CT exams have natural cooling times built-in during patient preparation times. Thus, a goal of the associated heat exchange system is to manage the dynamic nature of heat production and flow.

According to an illustrative embodiment, one or more surfaces of insert wall 303 in contact with the sub-cooled high temperature working fluid comprise a sintered surface to provide cavities, or reentrant cavities, that act as nucleation sites for the bubble formation. These cavities promote bubble formation on the surfaces of insert wall 303, and thus enhance heat transfer to the sub-cooled high temperature working fluid. Alternatively, the heat transfer surfaces, e.g., of insert wall 303, can be similarly augmented by other suitable means to roughen the surfaces and thereby promote bubble formation.

The heat removed from insert wall 303 is transmitted, via the sub-cooled high temperature working fluid, to casing wall 308. Surrounding at least a portion of casing wall 308 is air/fin layer 312. Air/fin layer 312 comprises a plurality of heat transfer fins oriented to allow air to pass therethrough. Namely, as will be described in detail below, air circulated through the heat transfer fins of air/fin layer 312 will serve to remove heat from the working fluid. Air/fin layer 312 replaces the remote fluid-to-air heat exchangers typically found in CT X-Ray tubes, e.g., fluid-to-air exchanger 130 associated with X-Ray tube 100 in FIG. 1, described above. The airflow over the fins of air/fin layer 312 is provided by a fan integral to X-Ray tube 216, e.g., fan 318, described below. Fins for efficient airflow heat transfer are well known to those of skill in the art and are not described further herein.

In turn, surrounding air/fin layer 312 is air shroud layer 314. Air shroud layer 314 can be composed of any suitable air shrouding material, including, but not limited to, nylon or a nylon-containing material. By way of example only, air shroud layer 314 can be composed of a tungsten-nylon alloy. Based on the composition of air shroud layer 314, air shroud layer 314 can be configured have radiation shielding properties, as is common with one or more of the outer layers of an X-Ray tube. For example, when air shroud layer 314 is composed of a tungsten-nylon alloy, as described above, air shroud layer 314 has radiation shielding properties. Further, one or more other layers of X-Ray tube 216, in addition to, or in place of, air shroud layer 314 can be configured to have radiation shielding properties. By way of example only, casing wall 308 can be configured to have radiation shielding properties (e.g., with air shroud layer 314 having minimal or no radiation shielding properties). According to one illustrative embodiment, casing wall 308 comprises an aluminum body with lead bonded to an interior surface.

Air shroud layer 314 and casing wall 308, having air/fin layer 312 therebetween, form a contained airflow passageway. The contained airflow passageway is continuous with the area surrounding fan 318, which, as described above, can be mounted on rotor 316. During normal operation, rotor 316 spins electron beam target 306. In turn, rotor 316 will also spin fan 318. Fan 318 causes air to be circulated throughout the contained airflow passageway, and between the fins of air/fin layer 312. As such, the heat transferred to air/fin layer 312 from the working fluid is dissipated to the circulated air. The heated air exits the CT gantry to the ambient, e.g., room, air. According to an alternative embodiment, fan 318 is not controlled by rotor 316 and is configured to operate by its own motor (not shown).

According to an illustrative embodiment, the components of the integrated cooling system, described above, make up at least a portion of a frame structure of X-Ray tube 216. Namely, air shroud layer 314, air/fin layer 312, casing wall 308 and insert wall 303 can make up the frame structure for X-Ray tube 216.

The components of the integrated cooling system will be described in further detail below, e.g., in conjunction with the description of FIG. 4. Namely, section 340 is shown in an amplified view in FIG. 4 and the components contained therein will be described below.

One design consideration for X-Ray tube 216 is to have the integrated cooling system in close proximity to one or more of the heat-radiating surfaces, e.g., the electron beam source and/or the electron beam target. Placing the heat-radiating surfaces in close proximity to the integrated cooling system is especially important for those surfaces that radiate the greatest amounts of heat, e.g., the surfaces of electron beam target 306. According to an illustrative embodiment, and as shown in FIG. 3, X-Ray tube 216 can be configured to have a shape that places a portion of the cooling system, e.g., portion 322, in close proximity to the surface of electron beam target 306.

X-Ray tube 216 further comprises high performance electron beam collector 324 and associated electron beam collector cooling system 326. Electron beam collector cooling system 326 includes fluid conduits 328, 330 and 332, pump 334, fluid-to-air heat exchanger 336 and fluid channel 338 surrounding high performance electron beam collector 324.

During imaging, high performance electron beam collector 324 absorbs a large amount of heat, e.g., up to about 40 percent of the total primary electron beam energy. According to an illustrative embodiment, electron beam collector cooling system 326 cools high performance electron beam collector 324 through the use of a high temperature working fluid, such as Therminol®, which is in a pressurized state, i.e., sub-cooled, as described above. The sub-cooled high temperature working fluid is brought in close proximity to high performance electron beam collector 324 via fluid channel 338. Fluid channel 338 can comprise a vacuum chamber made of any suitable material, including but not limited to, stainless steel.

As described above, heat absorbed by high performance electron beam collector 324 causes nucleate boiling in the sub-cooled high temperature working fluid in fluid channel 338. The bubbles produced carry heat away from the high performance electron beam collector 324 and into the sub-cooled high temperature working fluid. As such, fluid channel 338 can have one or more sintered surfaces to form nucleation sites, as described above. While the working fluid in electron beam collector cooling system 326 is described as a sub-cooled high temperature working fluid, it is to be understood that other working fluids, including, but not limited to, oil, can be similarly employed in electron beam collector cooling system 326.

The sub-cooled high temperature working fluid is circulated through electron beam collector cooling system 326 by pump 334. Namely, pump 334 draws the sub-cooled high temperature working fluid from fluid channel 338, e.g., via fluid conduit 328, and pumps the sub-cooled high temperature working fluid into fluid-to-air heat exchanger 336, e.g., via fluid conduit 330.

Fluid-to-air heat exchanger 336 removes heat from the working fluid by either passive or forced air cooling. Thus, according to one illustrative embodiment, fluid-to-air heat exchanger 336 is a passive fluid-to-air heat exchanger. Alternatively, according to another illustrative embodiment, fluid-to-air heat exchanger 336 comprises a fan and is a forced fluid-to-air heat exchanger.

Pump 334 then re-circulates the cooled sub-cooled high temperature working fluid back into fluid channel 338, e.g., via conduit 332. During operation, the circulating and cooling functions of electron beam collector cooling system 326 are performed continuously.

Figure 4:
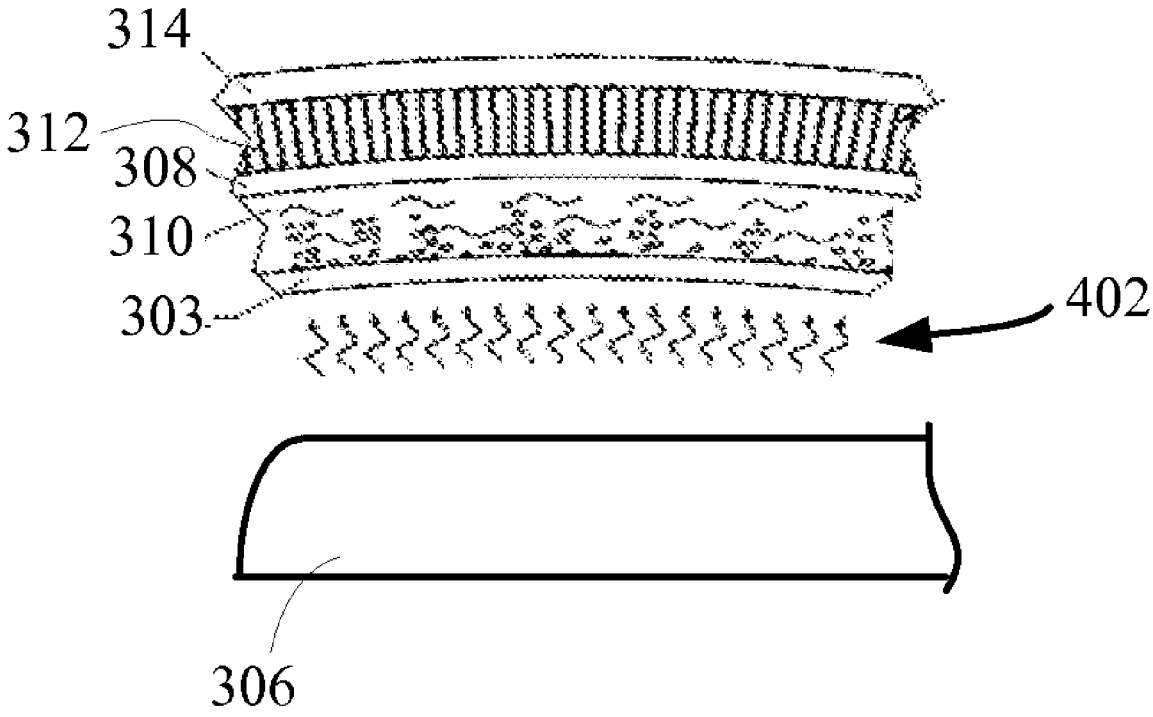
FIG. 4 is a diagram illustrating an enlarged view of a section of the integrated cooling system shown in FIG. 3.

FIG. 4 is a diagram illustrating an enlarged view of section 340 of the integrated cooling system shown in FIG. 3. FIG. 4 shows the components of the integrated cooling system described above, namely insert wall 303 and casing wall 308 defining cavity 310 therebetween, air fin layer 312 and air shroud layer 314. Insert wall 303 and casing wall 308 define cavity 310 therebetween. Cavity 310 contains a sub-cooled high temperature working fluid. Casing wall 308 and air shroud layer 314 form a contained air flow passageway around air fin layer 312.

As indicated by arrows 402, heat radiated by target 306 first encounters insert wall 303. The heat is then transferred to the sub-cooled high temperature working fluid in cavity 310. Nucleate boiling of the sub-cooled high temperature working fluid results in heat being efficiently transferred to air/fin layer 312 where, as described above, circulating air will be employed to remove the heat from the X-Ray tube.

CONCLUSION

Systems and apparatus for integrated X-Ray tube cooling have been described. Although specific embodiments are illustrated and described herein, any arrangement which is calculated to achieve the same purpose may be substituted for the specific embodiments shown. This application is intended to cover any adaptations or variations. In particular, the names of the systems and apparatus are not intended to limit embodiments. Furthermore, additional apparatus can be added to the components, functions can be rearranged among the components, and new components to correspond to future enhancements and physical devices used in embodiments can be introduced without departing from the scope of embodiments. Embodiments are applicable to future X-Ray imaging systems and different imaging devices.

We claim:

1. An X-Ray tube comprising:

a frame structure surrounding at least a portion of an electron beam source and an electron beam target, wherein the frame structure includes a cooling system integrated therein, the cooling system comprising:

at least one air/fin layer; and a sub-cooled working fluid in thermal contact with the at least one air/fin layer, the sub-cooled working fluid being adapted to undergo a phase change in response to heat introduced to the frame structure by one or more of the electron beam source and the electron beam target, wherein the phase change facilitates transfer of the heat to the at least one air/fin layer.

2. The X-Ray tube of claim 1, further comprising an air shroud layer surrounding at least a portion of the air/fin layer.

3. The X-Ray tube of claim 2, wherein the air shroud layer is composed of a nylon-tungsten alloy.

4. The X-Ray tube of claim 2, wherein the air shroud layer has radiation shielding properties.

5. The X-Ray tube of claim 1, wherein the sub-cooled working fluid is in a pressurized state.

6. The X-Ray tube of claim 1, wherein the phase change comprises vaporization as a result of nucleate boiling.

7. The X-Ray tube of claim 1, wherein the sub-cooled working fluid is contained in a cavity, and wherein one or more walls of the cavity have a plurality of nucleation sites.

8. The X-Ray tube of claim 1, wherein the sub-cooled working fluid is contained in a cavity having one or more sintered surfaces, the sintered surfaces providing a plurality of nucleation sites.

9. The X-Ray tube of claim 1, wherein the air/fin layer comprises a plurality of fins.

10. The X-Ray tube of claim 1, wherein the frame structure further comprises:

an insert wall surrounding at least a portion of the electron beam source and the electron beam target;

a casing wall surrounding at least a portion of the insert wall and defining a cavity therebetween; and an air shroud layer surrounding the at least one air/fin layer.

11. The X-Ray tube of claim 10, wherein the insert wall is composed of stainless steel.

12. The X-Ray tube of claim 10, wherein the casing wall is composed of an aluminum body with lead bonded to one or more interior surfaces thereof.

13. The X-Ray tube of claim 1, wherein the integrated cooling system further comprises a fan configured to circulate ambient air through the air/fin layer.

14. The X-Ray tube of claim 13, further comprising a rotor connected to the electron beam target and configured to spin the electron beam target, and wherein the fan is operated by the rotor.

15. The X-Ray tube of claim 13, further comprising a motor configured to operate the fan.

16. A medical X-Ray tube comprising:

a frame structure surrounding at least a portion of an electron beam source and an electron beam target, wherein the frame structure includes a cooling system integrated therein, the cooling system comprising:

at least one air/fin layer; and a sub-cooled working fluid in thermal contact with the at least one air/fin layer, the sub-cooled working fluid being adapted to undergo a phase change in response to heat introduced to the frame structure by one or more of the electron beam source and the electron beam target, wherein the phase change facilitates transfer of the heat to the at least one air/fin layer; and an electron beam collector having an electron beam collector cooling system associated therewith, the electron beam collector cooling system comprising:

a fluid channel surrounding at least a portion of the electron beam collector;

a fluid-to-air heat exchanger connected to the fluid channel; and a pump configured to circulate a sub-cooled working fluid through the fluid channel and the fluid-to-air heat exchanger.

17. The medical X-Ray tube of claim 16, wherein the fluid-to-air heat exchanger is a passive fluid-to-air heat exchanger.

18. The medical X-Ray tube of claim 16, wherein the fluid-to-air heat exchanger is a forced fluid-to-air heat exchanger.

19. A computed tomography imaging system having a gantry with an array of X-Ray detectors mounted opposite an X-Ray tube, the X-Ray tube comprising:

a frame structure surrounding at least a portion of an electron beam source and an electron beam target, wherein the frame structure includes a cooling system integrated therein, the cooling system comprising:

at least one air/fin layer; and a sub-cooled working fluid in thermal contact with the at least one air/fin layer, the sub-cooled working fluid being adapted to undergo a phase change in response to heat introduced to the frame structure by one or more of the electron beam source and the electron beam target, wherein the phase change facilitates transfer of the heat to the at least one air/fin layer.

20. The computed tomography imaging system of claim 19, wherein the computed tomography imaging system further comprises a medical computed tomography imaging system.

* * * * *